United States Patent [19]

Malott

[11] 4,000,688

[45] Jan. 4, 1977

[54] VENTILATOR FOR ROOF RIDGE

[75] Inventor: Richard C. Malott, Spring Lake, Mich.

[73] Assignee: Leigh Products, Inc., Coopersville, Mich.

[22] Filed: July 18, 1975

[21] Appl. No.: 597,029

[52] U.S. Cl. ..... 98/42 A; 98/121 A; 52/473

[51] Int. Cl.[2] ..... F24F 13/08

[58] Field of Search ..... 98/42 A, 37, 40 D, 114, 98/121 A; 52/473

[56] References Cited

UNITED STATES PATENTS

| | | | |
|---|---|---|---|
| 408,599 | 8/1889 | Elkins | 52/675 |
| 459,625 | 9/1891 | Bostwick | 52/674 |
| 514,313 | 2/1894 | Eckstein | 52/674 |
| 835,966 | 11/1906 | Lyster | 98/42 |
| 1,336,945 | 4/1920 | Dickelman | 52/199 X |
| 1,449,294 | 3/1923 | Respess | 98/94 UX |
| 2,126,525 | 8/1938 | Anderson | 98/121 R |
| 2,410,950 | 11/1946 | Knutson | 98/42 |
| 2,704,500 | 3/1955 | Bonforte | 98/42 |
| 3,018,713 | 1/1962 | Anderson | 98/40 D X |
| 3,036,508 | 5/1962 | Halvorson | 98/32 |
| 3,072,230 | 1/1963 | Gelert | 189/82 |
| 3,073,235 | 1/1963 | Smith et al. | 98/32 |
| 3,185,070 | 5/1965 | Smith | 98/42 |
| 3,260,026 | 7/1966 | Bacon | 98/121 X |
| 3,326,113 | 6/1967 | Smith et al. | 98/42 |
| 3,948,155 | 4/1976 | Hedrick | 98/40 D |

*Primary Examiner*—William E. Wayner
*Attorney, Agent, or Firm*—Price, Heneveld, Huizenga & Cooper

[57] ABSTRACT

An improved roof ridge ventilator is provided having a peaked hood, descending sidewalls, horizontally extending panels and a dam arrangement defined by a vertically extending, reversed bent inner sidewall. Flashing sections are integral with the inner sidewalls. A plurality of rows of vent passages are formed in the panels. Each row of these passages is hooded by oppositely disposed, alternating offset straps. Vent passages are provided along the outer edge of the panels and are partially covered by downwardly and inwardly inclined baffles.

9 Claims, 5 Drawing Figures

VENTILATOR FOR ROOF RIDGE

BACKGROUND OF THE INVENTION

This invention relates to natural attic ventilation systems and, more particularly, it concerns an improved ridge vent assembly for use in such systems capable of being easily manufactured, at low cost, and providing excellent weather and insect protection.

Attic ventilation systems are employed with buildings in order to remove warm air from the attic during the summer months to thereby assist in reducing the air conditioning load. Attic ventilation systems also function to remove moisture which will condense within the attic during the winter months. This prevents soaking and deterioration of the ceiling insulation material.

Such ventilation systems generally include an eaves ventilator as well as a roof ridge ventilator extending longitudinally the length of the building. The systems must be compact and aesthetically pleasing while still being capable of withstanding exposure to high winds, rain, snow, hail, sunlight and various forms of air pollution. The ventilation systems must also function to prevent the ingress of dirt, moisture and insects to the attic space being ventilated.

Ridge vents have generally taken the form of T-shaped, hood-like sections joined together and extending longitudinally along the ridge of a roof. The building is formed with a ventilation opening at the peak extending longitudinally between the rafters which is in communication with the ridge vent. U.S. Pat. No. 3,073,235 issued Jan. 15, 1963 to L. L. Smith, et. al., entitled ROOF VENTILATORS is an example of such a prior art system. This patent discloses a plurality of rows of openings formed in the panel portions to provide air circulation. However, these air openings are formed by a single lance and protected by louvers resulting in very restricted air flow capacity. With this structural arrangement, the vent openings may be subject to blockage. Due to the flow pattern resulting from the use of louvers only; the air flow per unit area is limited.

U.S. Pat. No. 3,311,047 issued Mar. 28, 1967 to L. L. Smith, et al., entitled ROOF VENTILATORS relates to a similar roof ventilator structure including, however, an internal baffle arrangement in which the inner wall portions are extended vertically to form a baffle or dam. The vent structure of this patent also includes a plurality of longitudinally and laterally extending rows of vent passages covered, however, by outwardly extending, outwardly inclined, single-lanced baffles or louvers.

While both of these examples of the prior art function fairly efficiently due to the manner in which the vent passages and the panels are formed, relatively large restrictions are presented to air flow. This subjects the passages to possible blockage and the structure is not as rigid as would be desired to withstand all possible weather conditions. Further, with some prior art examples of ridge ventilators, separate insect screening must be employed to meet F.H.A. and local building code requirements.

SUMMARY OF THE INVENTION

In accordance with the present invention, an improved roof ridge ventilator is provided, having increased flow area, increased efficiency, the capability of preventing entry of moisture, insects and dirt particles to a ventilated space while still retaining compact size, low cost and ease of manufacture. Essentially, a roof ridge ventilator adapted to extend longitudinally of a roof ridge is provided including a peaked hood having angle descending top portions and angled descending sidewalls which are integrally joined with inwardly, horizontally extending panels. A dam or baffle arrangement is formed by an upwardly and downwardly extending, reversed bent inner wall. A flashing portion extends outwardly and at a descending angle with respect to the inner sidewall portion. The outer edge of the flashing portion includes a slight stiffening lip to assist in installation.

Each of the horizontally, outwardly extending panels of the ridge ventilator includes a plurality of longitudinally and laterally extending rows of vent openings. These openings are formed by a double lance and offset process resulting in a plurality of rows of offset straps functioning as hoods at each vent passage. The offset straps in alternate rows are offset oppositely from and their central portions are parallel to the plane of the panel, providing double entry air flow passages having increased air flow area with correspondingly increased efficiency and reduced restriction. A single row of longitudinally extending, single-lanced openings is provided adjacent the longitudinally extending outer edge of the panels.

Among the objects of the present invention, therefore, are: the provision of an improved roof ridge ventilator providing a total flow area through the panels substantially equal to the flow area of the ventilation passage formed in the roof ridge; the provision of a ridge vent having increased efficiency while retaining structural rigidity, thereby being capable of withstanding exposure to the elements, such as hail, heavy snow and high winds; the provision of an improved ridge vent capable of preventing entry of insects, moisture and dirt particles; the provision of an improved ridge vent having good air flow characteristics from the attic outwardly through the panels while being capable of reducing the velocity of the air flow from the outside into the attic while retaining sufficient flow area; the provision of a ridge vent employing a plurality of longitudinally and laterally extending rows of offset straps oppositely positioned and offset normal to the plane of the panel; and the provision of an improved ridge vent having compact size, pleasing aesthetics, low cost, minimum parts, and ease of manufacture.

DETAILED DESCRIPTION OF THE PREFERRED EMBODIMENT

Figure 1:
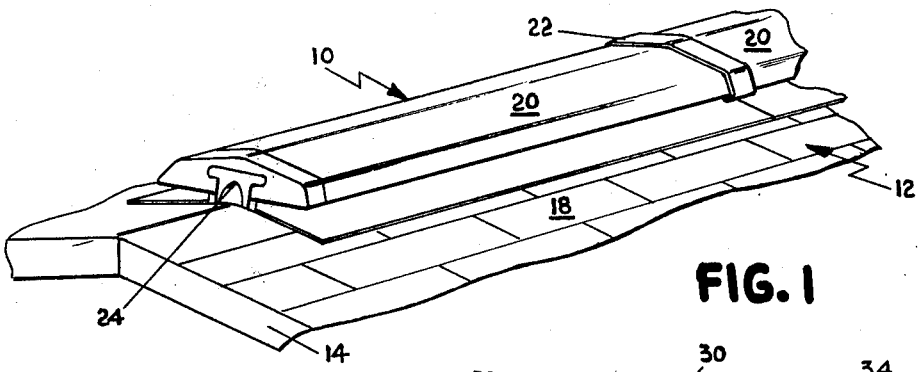
FIG. 1 is a fragmentary, perspective view showing the ridge ventilator of the subject invention mounted on a roof.
Figure 2:
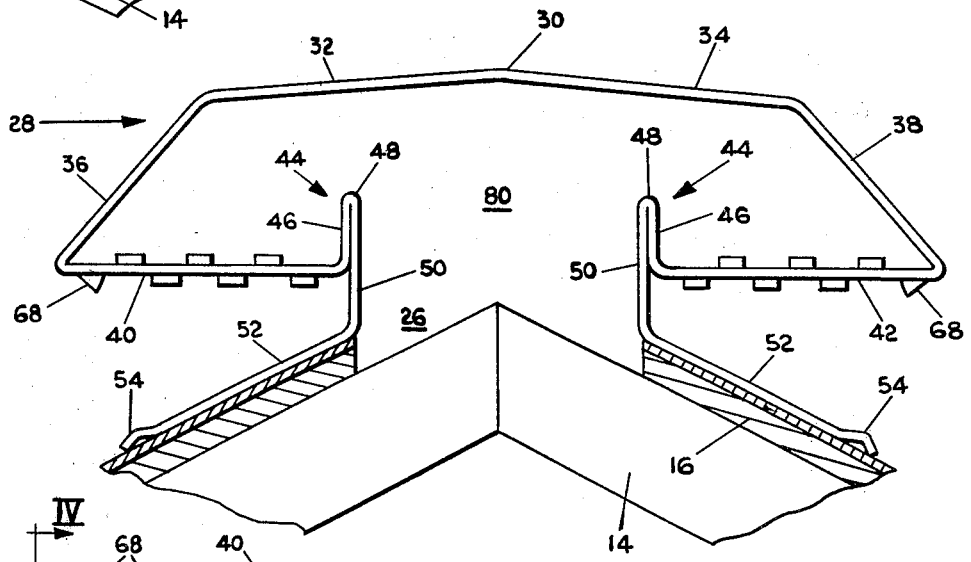
FIG. 2 is an end elevation view of the ventilator illustrated in FIG. 1.

With reference to the drawings, FIG. 1 illustrates a ridge vent assembly, generally designated 10, mounted at the peak or the ridge of a roof 12. The roof structure is conventional and includes rafters 14, sheathing boards 16, as best seen in FIG. 2, and shingles 18. The ridge vent assembly 10 is formed from a plurality of longtiudinally extending ridge vent sections 20. Each section 20 is joined by a connector 22. The ends of the ridge vent assembly are closed by end caps 24.

As seen in FIG. 2, the ends of the sheathing boards 16 terminate short of the roof ridge to define a roof ridge ventilation opening or air passage 26 extending longitudinally between rafters 14. Each ridge vent section 20 is secured above the roof ridge vent opening 26.

The ridge vent section includes a cover or hood 28 having a hood peak 30 and downwardly extending, angled tops 32 and 34. The angled tops are followed by downwardly extending and more acutely angled outer sidewalls 36 and 38. The lower ends of the outer sidewalls are integral with inwardly extending, horizontal panels 40 and 42. The inner ends of the panels are integral with a dam structure 44 defined by an upwardly extending lip portion 46, terminating at a longitudinally extending edge 48 and reverse bent to form a downwardly extending inner sidewall 50. These sidewalls define the ventilation throat 80. The inner sidewalls 50 are followed by angled flashing sections 52. Each flashing section includes a longitudinally extending stiffening lip 54. Suitable fasteners such as screw nails (not shown) may be employed to attach the ridge vent sections to the roof at the flashing sections.

Figure 3:
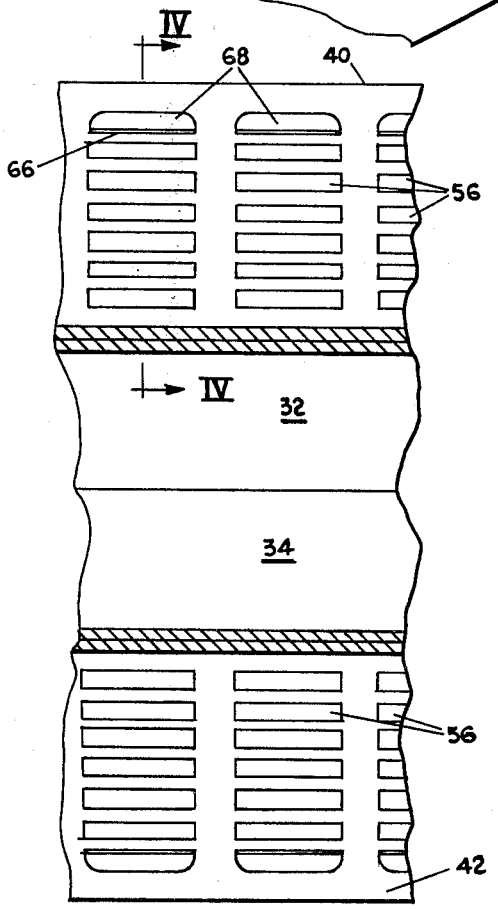
FIG. 3 is a fragmentary, bottom view of a ridge vent in accordance with the subject invention.
Figure 4:
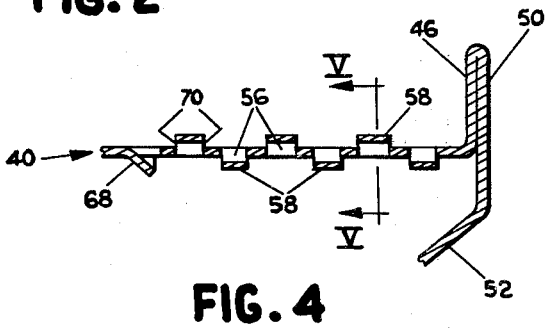
FIG. 4 is a partial cross-sectional view taken along lines IV—IV of FIG. 3.
Figure 5:
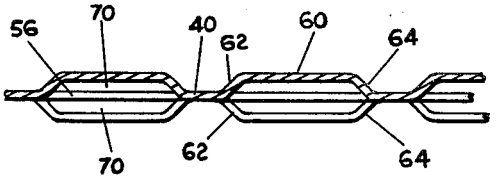
FIG. 5 is a cross section along lines V—V of FIG. 4.

As best seen in FIGS. 2, 3 and 4, each panel 40 and 42 includes a plurality of longitudinally extending vent openings 56 arranged in tandem. The vent openings 56 are hooded by oppositely projecting, offset straps 58. The offset straps 58 include longitudinally extending tops 60 and angled ends 62 and 64 which connect the tops 60 to the panels 40 and 42. By virtue of the double lance and offset process by which the straps 58 are formed, the metal of the panel is displaced normal to the plane of the panel with the center portion of the straps being in a plane parallel to that of the panel. The arrangement of the straps provides an air passage 70 for air flow from both sides of the strap (FIGS. 4 and 5). Thus, the amount of offset of the straps can be materially reduced without adversely restricting air flow. This makes it possible to so limit the amount of offset that the entry of many insects, particularly the nuisance variety such as flies and wasps is prevented.

The air flow capacity of the unit is also materially increased by offsetting alternate rows in opposite directions. By so doing, the rows can be located close to each other, crosswise of the panel, without the straps being so close together that air access to the side openings or air passages 70 is so restricted that the full air flow capacity of the air passages 70 can not be utilized. This arrangement makes it possible to provide greater air flow capacity through narrower panels 40 and 42. This, in turn, reduces the overall size of the ventilator thus reducing cost and making possible a more rigid and sturdy product with a thinner gauge of material.

No structural metal is removed from the panel. Further, by virtue of the offset operation in both directions from the plane of the original sheet material, the moment of inertia of the resulting panel is significantly increased giving the panel greatly increased rigidity and strength. This materially increases the ability of the ventilator to withstand exposure to the elements, including hail and gale force winds.

The offset straps 58 serve as hoods to protect the vent openings 56 and prevent the ingress of rain, snow and dirt particles to the interior of the attic space. The total flow area through the vent openings 56 formed in the panels 40 and 42 is substantially equal to the total flow area of the roof ridge vent opening or passage 26. The arrangement of the straps permits a steady smooth movement of air through the ventilator. It is particularly effective for the discharge of a steady, smooth flow of hot air from the interior of the building. At the same time, its design creates a turbulent, velocity absorbing air flow pattern under high velocity air flow conditions, such as occur during high wind and gusty wind conditions. The pattern thus created causes airborne snow, rain and dirt to separate and fallout before it can be carried up over the dam 44.

Each panel 40 and 42 is also provided with a row of longitudinally spaced openings 66 arranged in tandem. These openings 66 are lanced only on one side, i.e., the side closest to the ventilation opening 26 and, therefore include an inwardly and downwardly inclined baffle 68. This baffle 68 functions as a deflector to turn back or deflect winds approaching the ridge vent sections 20 from a transverse direction. The resulting increased turbulence or reversal of the air flow further assists in the removal of moisture and/or dirt particles from the air.

The dam 44 including the upwardly extending lip 46 and the downwardly extending inner sidewall 50 serves to prevent moisture collecting on the panels from directly entering the attic through the ventilation opening 26. Further, the air entering the ridge vent which strikes the dam 44 is at least deflected 90° and under other conditions its flow is reversed in direction. This also assists in removal of moisture and dirt particles from the entering air stream.

Due to the fact that the depth of the oppositely disposed offset straps 58 set by the length and angle of the ends of the straps 62 and 64 may be kept small, the panels themselves function as an effective insect screen. However, the double air flow entry arrangement still results in a high flow area.

The overall structural arrangement of the ridge vent is maintained compact in size and of low profile and aesthetically pleasing while still providing good weather protection, damage resistance and the ability to withstand the elements and provide weather protection to the interior attic space. The opposite, alternating strap offset arrangement also serves to prevent blockage of the vent openings since a double air flow entry area is provided. The offsets 58 while providing weather protection also function to increase the strength and rigidity of the panel. The ridge vent assembly permits the attic space to breath in the summer, thereby keeping the attic cooler and reducing both the necessity for air conditioning and when air conditioning is used the load imposed on the system. Further, the venting permits moisture to be vented from the attic space in the winter thereby preventing soaking and subsequent destruction of the insulation material.

Each ridge vent section 20 may be formed as a continuous member from suitable aluminum coil stock by a rolling mill process. A suitable material is 0.024 gauge aluminum. As a result, the ridge vent of the subject invention is easily manufactured at a low cost.

Thus, it will be appreciated that the present invention provides a ridge vent assembly of compact size, low weight and relative low cost. The overall ridge vent assembly is easily manufactured and provides good structural rigidity to withstand exposure to the elements while permitting highly efficient ventilation of an attic space. Further, the attic is protected from ingress of moisture and dirt and the ridge vent assembly, itself, functions as an effective insect screen. It is expressly intended, therefore, that the foregoing description is illustrative of the preferred embodiment only and is not to be considered limiting. The true spirit and scope of the present invention will be determined by reference to the appended claims.

The embodiments of the invention in which an exclusive property or privilege is claimed are defined as follows:

1. A ridge vent for a roof having a cover portion and a pair of generally inwardly extending panels beneath and vertically spaced from said cover and means for securing said vent to a roof with said panels above and spaced from the roof, said ridge vent characterized in that said panels each have a plurality of elongated ventilation openings therein; said openings being arranged in tandem in a plurality of laterally spaced rows; each of said openings having an elongated strap overlying the same, integral with said panel; each of said straps having a center portion in a plane offset from and parallel to the plane of said panel for defining a pair of laterally opening air flow passages one on each side of said strap, and said straps in alternate rows being offset in opposite directions from the plane of said panel.

2. The ridge vent described in claim 1 wherein each of said straps is offset from the plane of said panel such that said air passages are too small for the passage of most nuisance insects such as flies and wasps.

3. A ridge vent for a roof having a cover portion, a flashing portion adapted to be secured to a roof and an upstanding throat portion narrower than said cover portion interconnected to said cover portion by laterally extending panels, said ridge vent characterized in that said panels each have a plurality of elongated ventilation openings therein; said openings being arranged in tandem in a plurality of laterally spaced rows; each of said openings having an elongated strap overlying the same, integral with said panel; each of said straps having a center portion in a plane offset from and parallel to the plane of said panel for defining a pair of laterally opening air flow passages, one on each side of said strap, and a row of downwardly and inwardly inclined baffles are provided in each of said panels between said ventilation openings and the juncture of said cover portion and said panels, each of said baffles shielding and defining an inwardly and downwardly opening air passage.

4. A ridge vent for a roof comprising: a cover portion, a flashing portion adapted to be secured to a roof and walls defining a throat portion narrower than said cover portion; laterally extending, generally horizontal panels integral with the outer extremities of said cover portion, a pair of upstanding dam members integral with said throat walls and with said panels, said dam members projecting above said panels; each of panels having a plurality of elongated ventilation openings therein; said openings being arranged in tandem in a plurality of laterally spaced rows; each of said openings having an elongated strap overlying the same, integral with said panel; each of said straps having a center portion in a plane offset from and parallel to the plane of said panel for defining a pair of laterally opening air flow passages, one on each side of said strap, and said straps in alternate rows being offset in opposite directions from the plane of said panel.

5. A ridge vent assembly including a plurality of sections extending longitudinally along a roof ridge ventilation opening, each section joined by connectors and the ends of the assembly closed and sealed by end caps, wherein each ridge vent section comprises:

a hood including downwardly and outwardly angled top portions defining a longitudinally extending peak;

outer sidewall portions integral with said top portions and downwardly and outwardly angled with respect to said top portions;

panel portions inwardly extending, horizontally disposed and integral with said outer sidewall portions, said panel portions having a plurality of longitudinally and laterally extending rows of vent openings formed therein, each of said vent openings being hooded by alternating, oppositely directed offset straps;

inner sidewalls integral with and downwardly extending with respect to said panel portions; and flashing portions integral with said sidewall portions and extending downwardly and outwardly with respect to said sidewall portions, said flashing portions adapted to be attached to the roof on either side of the roof ridge ventilation opening.

6. The ridge vent assembly as defined by claim 5 further including upwardly extending lips integral with the inner edge of said panel portions and integral with the upper end of said sidewall portions thereby defining a dam having a longitudinally extending edge positioned above said vent opening.

7. A ridge vent assembly including a plurality of sections extending longitudinally along a roof ridge ventilation opening, each section joined by connectors and the ends of the assembly closed and sealed by end caps, wherein each ridge vent section comprises:

a hood including downwardly and outwardly angled top portions defining a longitudinally extending peak;

outer sidewall portions integral with said top portions and downwardly and outwardly angled with respect to said top portions;

panel portions inwardly extending, horizontally disposed and integral with said outer sidewall portions, said panel portions having a plurality of longitudinally and laterally extending rows of vent openings formed therein, each of said vent openings being hooded by alternating, oppositely directed offset straps;

inner sidewalls integral with and downwardly extending with respect to said panel portions; and flashing portions integral with said sidewall portions and extending downwardly and outwardly with respect to said sidewall portions, said flashing portions adapted to be attached to the roof on either side of the roof ridge ventilation opening, and said panel portions have a longitudinally extending row of baffled vent openings adjacent the outer edge of said panel portions, and a plurality of downwardly and inwardly extending deflector baffles integral with said panel portions partially covering said longitudinally extending row of baffled vent openings adjacent said edge of said panel portions.

8. The ridge vent assembly as defined by claim 7 further including upwardly extending lips integral with the inner edge of said panel portions and integral with the upper end of said sidewall portions thereby defining a dam having a longitudinally extending edge positioned above said vent openings.

9. The ridge vent assembly as defined by claim 8 wherein said flashing portions include a longitudinally extending stiffening lip adjacent their outer edge.

* * * * *